United States Patent [19]

Ruckert

[11] 4,231,852

[45] Nov. 4, 1980

[54] DEVICE FOR CATHODIC CORROSION PROTECTION EMPLOYING AN EXTERNAL CURRENT ANODE

[75] Inventor: Hans Ruckert, Dortmund, Fed. Rep. of Germany

[73] Assignee: Vereinigte Elektrizitätswerke Westfalen AG, Dortmund, Fed. Rep. of Germany

[21] Appl. No.: 925,298

[22] Filed: Jul. 17, 1978

Related U.S. Application Data

[63] Continuation of Ser. No. 764,740, Feb. 1, 1977, abandoned.

[30] Foreign Application Priority Data

Feb. 10, 1976 [DE] Fed. Rep. of Germany ..... 2605088

[51] Int. Cl.[2] ..... C23F 13/00

[52] U.S. Cl. ..... 204/196

[58] Field of Search ..... 204/147, 148, 196, 197

[56] References Cited

U.S. PATENT DOCUMENTS

| | | | |
|---|---|---|---|
| 2,996,445 | 8/1961 | Eisenberg et al. | 204/196 |
| 3,046,213 | 7/1962 | Bender | 204/196 |
| 3,098,026 | 7/1963 | Anderson | 204/196 |
| 3,129,154 | 4/1964 | Fry | 204/196 |
| 3 ,135,677 | 6/1964 | Fischer | 204/196 |
| 3,142,631 | 7/1964 | Woodley | 204/196 |
| 3,497,444 | 2/1970 | Paiton | 204/196 |
| 3,830,719 | 8/1974 | Cavil | 204/196 |
| 3,959,107 | 5/1976 | Horner et al. | 204/195 F |

*Primary Examiner*—G. L. Kaplan

*Attorney, Agent, or Firm*—Toren, McGeady and Stanger

[57] ABSTRACT

A device for cathodic corrosion protection such as for hot water tanks having a passive anticorrosive layer on the inner wall of the tank. The cathodic corrosion protection employs the use of an external current anode. The device includes a holder which bears the external current anode and a reference electrode. The holder is adapted to be inserted into a single opening in the tank wall. A potentiostat employs the external current anode and reference electrode so as to establish a predetermined potential between reference electrode and the tank by regulating the current flowing through the external current anode to the tank. This provides the desired corrosion protection. Two embodiments of the device are described.

5 Claims, 2 Drawing Figures

DEVICE FOR CATHODIC CORROSION PROTECTION EMPLOYING AN EXTERNAL CURRENT ANODE

This is a continuation of Application Ser. No. 764,740 filed on Feb. 1, 1977 and now abandoned.

FIELD OF THE PRESENT INVENTION

The invention concerns a device for cathodic corrosion protection using an external current anode, particularly for hot water tanks with a passive anticorrosive layer, preferably of enamel, provided on the inner wall.

BACKGROUND OF THE PRESENT INVENTION

Hot water tanks with a small capacity, particularly for household purposes, have been provided heretofor with a passive anticorrosive layer (usually of enamel), as well as with a donor anode of magnesium. The magnesium anode is usually screwed into the tank from the top through a nipple, while the electric heating system is arranged above a flange in the lower part. It was found in practice that these hot water tanks are destroyed by corrosion after a few years, particularly in the lower region receiving the heating element.

Thorough investigations by means of potential- and current measurements have shown that the lower third will no longer be protected cathodically in such hot water tanks when the heating flange is not insulated from the tank. This insulation is not usually provided for electrotechnical reasons. The use of magnesium donor anodes has other disadvantages, namely a magnesium anode has considerable natural corrosion so that it is also frequently completely destroyed or used up after a few years. Furthermore, a considerable amount of hydrogen gas is formed on a magnesium anode which combines with oxygen to form a dangerous oxyhydrogen mixture.

In larger tanks, it has already been suggested to use, instead of magnesium donor anodes, electrodes supplied with external current. This does not lead to a satisfactory result either, because the external current electrodes used in the past for larger hot water tanks were always set to a single current. Accordingly, when the conditions changed in the tank, e.g., when an additional defective spot appeared in the passive anticorrosive layer, the correct potential was no longer set on the tank wall. Furthermore, the present external current electrodes do not provide a satisfactory solution of the special corrosion hazard in the area of the heating element of a water tank equipped with such a heating element. The damage in this region is caused by the surfaces acting as a cathodic region on which oxygen is reduced so that they can act as oxidants, and any defective spots in the passive anticorrosive layer appearing in this region are particularly subject to corrosion.

In order to achieve a long-term improvement of the corrosion protection in these tanks, it is suggested in copending U.S. patent application Ser. No. 764,903 filed Feb. 1, 1977 and now abandoned, to design the electrodes so that they can be controlled to an optimum potential by means of a known potentiostat and a similarly known reference electrode. As indicated in the aforementioned copending application, potentiostats together with suitably spaced anodes and reference electrodes, have been used in the protection of ships hulls and pipes containing flowing water. Prior to the copending U.S. patent application, it was believed that while the approach was satisfactory in systems wherein gaseous by-products would freely pass into the atmosphere, the hydrogen and oxygen produced electrochemically by the current flow would, in closed systems such as hot water tanks, collect as a dangerous explosive mixture. It was discovered, however, that by maintaining the tank wall at a negative potential, and by the automatic current regulation provided by the potentiostat, dangerous accumulations of the oxyhydrogen mixture were avoided. In this application, at least one external current anode is arranged in the proximity of the heating element, possibly centrally and equally far from all wall surfaces. The reference electrode, however, is to be as close as possible to the tank wall, so that the reference electrode and the external current anode are arranged separately according to this copending U.S. Patent application and are connected with the potentiostat by separate lines.

Because of this arrangement, separate holders must be provided for the reference electrode and the external current anode, and correspondingly, separate openings or inserts must be provided in the tank wall. In this assembly, connections must be provided between the potentiostat and the reference electrode, between the potentiostat and the external current anode, and between the potentiostat and the surface or tank wall. The manufacture of such tank requires a great expenditure of energy and time by skilled workers.

SUMMARY OF THE PRESENT INVENTION

An object of the invention is to provide a device generally applicable for cathodic corrosion protection, which can be used preferably for tanks of the above described type. It is also contemplated that such device is applicable to other tanks and other purposes, for example, tanks without electric heating, or other surfaces to be protected, which are similar in design and can be assembled by a few unskilled workers.

In accordance with the present invention, a device for cathodic corrosion protection such as for hot water tanks having a passive outer corrosive layer on the inner wall of the tank wherein the protection includes the use of an external current anode comprises a holder adapted for insertion into a tank wall. An external current anode is disposed on the holder. A reference electrode is also disposed on the holder so as to be close to the tank wall when the holder is inserted into the tank wall. The reference electrode is for use with a means for controlling current flowing through the external current anode. An insulating piece is also provided between the reference electrode and the external current anode and which extends into the tank.

For a better understanding of the present invention together with other and further objects thereof, reference is made to the following description and accompanying drawings while the scope of the invention is pointed out in the appended claims.

DESCRIPTION OF THE INVENTION

Figure 1:
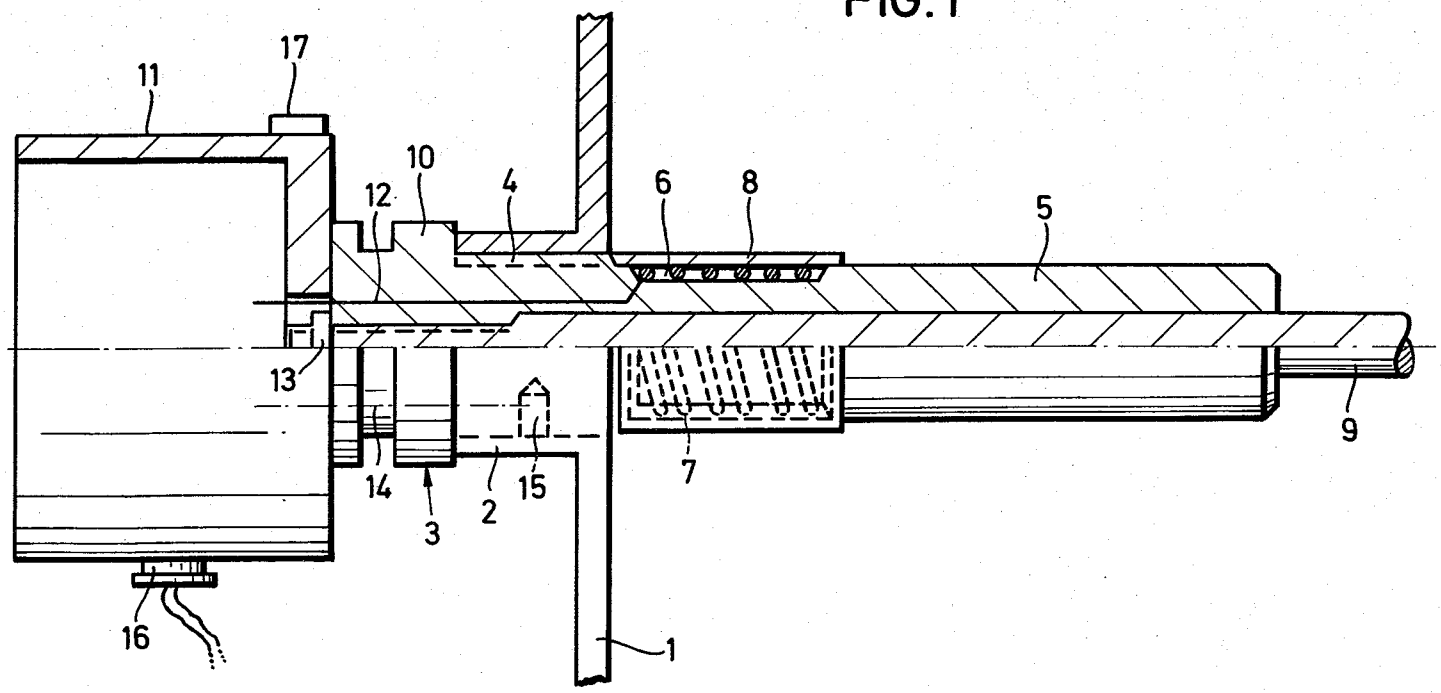
FIG. 1 shows, in a partial vertical section, a device according to the invention as installed in a tank wall.

Referring to FIG. 1, in a tank wall 1, a threaded nipple 2 is provided into which is screwed a holder 3 with a corresponding threaded part 4. Holder 3, which consists preferably of plastic, extends into the interior of the tank in an insulating piece 5. Piece 5 is provided next to tank wall 1 with an annular recess 6 in which is arranged a helical reference electrode 7 of Ag/AgCl. This recess is covered by a cylindrical sheathing 8 of liquid permeable material, e.g., a porous ceramic sleeve or a perforated jacket.

Centrally disposed through the entire holder 3 and the insulating piece 5 extends an external current anode 9, the length of the insulating piece being at least a multiple of the distance of the free end of reference electrode 7 from tank wall 1.

On the head of holder 3 is secured a potentiostat 11. Furthermore, an electrical connection exists between potentiostat 11 and reference electrode 7, and another electrical connection 13 exists between potentiostat 11 and external current anode 9. Finally, another electrical connection 14 is provided between potentiostat 11 and tank wall 1 and nipple 2 by means of a ground screw 15 which is screwed into the threaded part 4 of holder 3.

A terminal 16 is provided on potentiostat 11 for the current supply, e.g. with 220 V alternating current, as well as another terminal 17 for connection with other external current anodes to be arranged at other points of the tank.

Figure 2:
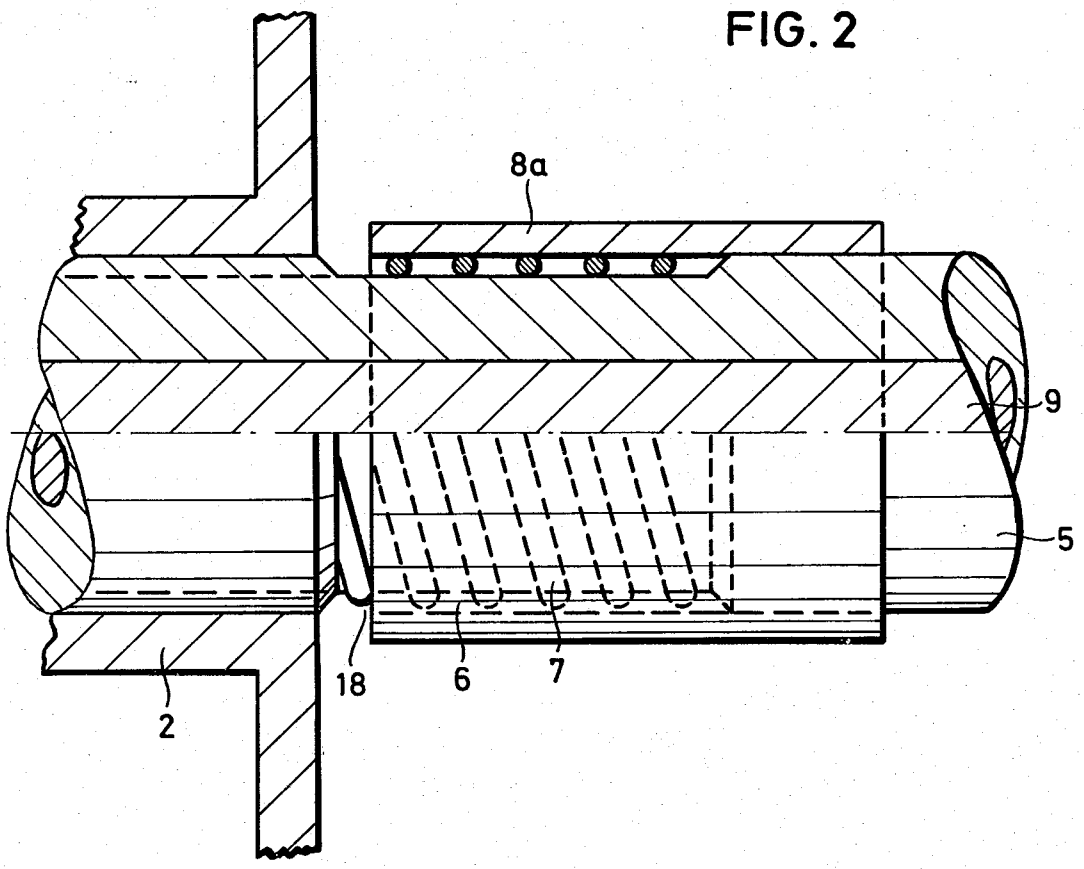
FIG. 2 shows a partial section through a modified region of a device according to FIG. 1.

In the embodiment according to FIG. 2, a cylindrical sheathing 8*a* for the helical reference electrode 7 is provided which consists of a sleeve with a closed surface and which leaves a gap 18 between tank wall 1 and the sleeve end, which gap is open to recess 6. This is done so that, on the one hand, the liquid surrounding the reference electrode 7 is hindered from flowing, and on the other hand, the function of the reference electrode is optimized due to the proximity of gap 18 to tank wall 1.

By a potentiostat as described above, a regulator is understood having the function to keep the measuring electrode of an electrochemical cell at a constant potential relative to a reference electrode, which can be adjusted by means of a nominal voltage source. To this end, the potentiostat amplifies a very small deviation of the potential of the measuring electrode from the nominal voltage and regulates the current flowing through the cell between the measuring electrode and counter-electrode.

This principle is applied to the present case of cathodic corrosion protection with external current by means of potentiostat 11 and reference electrode 7, where a negative potential is imposed on the subject to be protected, namely the tank wall 1, so that corrosion is prevented with a minimum of hydrogen evolution. If the potential of the tank wall 1 differs from the given nominal voltage, the potentiostat amplifies this small deviation and regulates the current flowing through the arrangement between the tank wall and external current anode 9 so that the voltage maintains its constant value. The predetermined potential ensures constant corrosion protection. The undesired evolution of hydrogen is prevented to a great extent and the current is regulated by the potentiostatic circuit just to the level which is required for corrosion protection, so that unnecessary current consumption is avoided.

A potentiostat required for a household hot water tank of about 80 liters capacity consists substantially of a transformer 220/2×18V, a rectifier and stabilizing unit composed of recitifiers, Zener diodes, transistors, capacitors, resistances, a so-called nominal voltage source including diodes, resistances and potentiometers, a differential- and pre-amplifier employing integrated circuit construction and of two transistors as a power amplifying output stage. The details of such a potentiostat are not a part of the present invention and are therefore not described in detail.

The assembly of the above described device is therefore extremely simple, since only holder 3 has to be screwed into nipple 2 and terminal 16 has to be applied to a suitable current source, establishing, if necessary, the connection between another external current anode to be arranged at another point of the tank and terminal 17.

The embodiment described above can be modified in many respects. Thus, the reference electrode could also have the form of one or more rods extending axially to the external current anode, but here too a flow-preventing sheathing for the reference electrode is preferably provided. The connection between the tank wall and the potentiostat can also be effected outside the head of the holder.

As has been described above, the external current anode and a reference electrode, which controls the external current anode by means of a known potentiostat to an optimum potential, are arranged on the same holder to be inserted into the tank wall, where the reference electrode is arranged in the operating state close to the tank wall, and an insulating piece is provided between this reference electrode and the external current anode which is arranged closer to the interior of the tank.

This arrangement results in a very simple design of the device. Furthermore, only one receiving hole has to be provided in the respective wall, and the assembly of the device is so simple due to the above described design, that it can be effected even by less skilled workers in a very short time.

As has been described, it is particularly expedient if the insulation piece has an extension substantially perpendicular to the tank wall which is at least a multiple of the distance of the free end of the reference electrode from the tank wall. This ensures that the potential on the tank wall is measured by the reference electrode undisturbed by influence of the external current anode, since the reference electrode is outside the so-called potential funnel of the external current anode.

A particularly favorable constructional design is obtained if the external current anode extends centrally through the insulating piece, particularly when the reference electrode is arranged in helical or annular form in a ring-shaped recess of the insulating piece, and this recess is covered by a flow-preventing sheathing. The latter quite substantially extends the service life of the reference electrode, which usually consists of Ag/AgCl.

As has also been described, it is of advantage if the sheathing is formed by a cylindrical sleeve with a closed surface, and an annular slot to the recess in the insulating piece remains between the tank wall and the head of the sleeve. This enhances the function of the reference electrode in the vicinity of the annular slot to the tank wall if the liquid flow about the reference electrode is prevented.

In a further development described above, it is particularly of advantage if the potentiostat is arranged stationary on the head of the holder, and the electrical connections between the potentiostat and the reference electrode as well as the external current anode are fixed in this head. This further contributes to the above mentioned simplification of the assembly.

The same result is obtained if a fixed electrical connection is provided on the head of the holder between the potentiostat and the tank wall.

Finally, one or more additional terminals can be provided for one or more additional external current anodes on the potentiostat, since it is advisable in many cases to arrange an additional external current anode in another region of the tank, for example, if an external current anode is to be arranged in the proximity of the heater provided in the lower part of a tank and another external current anode in the upper region of a substantially cylindrical tank.

While the foregoing description and drawings represent the preferred embodiments of the present invention, it will be obvious to those skilled in the art that various changes and modifications may be made therein without departing from the true spirit and scope of the present invention.

What is claimed is:

1. In combination, a hot water tank having a passive anticorrosive layer on an inner wall of the tank and a device for cathodic corrosion protection of said hot water tank device, the protection device including the use of an external current anode and comprising:

a holder adapted for insertion into a wall of said tank;

an external current anode disposed on said holder;

a reference electrode also disposed on said holder;

potentiostat means connected to the reference electrode and to the anode and connected to the tank wall for measuring a potential between the reference electrode and the tank wall and for continuously varying electrical current flow through said current anode sufficiently to keep said potential substantially constant; and an insulating piece being provided between the reference electrode and the external current anode and which extends into the tank;

wherein the insulating piece has an extension substantially perpendicular to the tank wall when inserted therein, said extension being at least a multiple of the length of the free end of the reference electrode from the tank wall; wherein the external current anode extends centrally through the insulating piece; and wherein said insulating piece has an annular recess, and the reference electrode is arranged in helical or ring form in an annular recess of the insulating piece, said recess being covered by the flow-reducing sheathing.

2. The combination according to claim 1, wherein the sheathing is formed as a cylindrical sleeve having a closed surface and an annular gap, which is open to the recess of the insulating piece, and remains between the tank wall and end of said sleeve.

3. In combination, a hot water tank having a passive anticorrosive layer on an inner wall of the tank and a device for cathodic corrosion protection of said hot water tank device, the protection device including the use of an external current anode and comprising:

a holder adapted for insertion into a wall of said tank;

an external current anode disposed on said holder;

a reference electrode also disposed on said holder;

potentiostat means connected to the reference electrode and to the anode and connected to the tank wall for measuring a potential between the reference electrode and the tank wall and for continuously varying electrical current flow through said current anode sufficiently to keep said potential substantially constant; and an insulating piece being provided between the reference electrode and the external current anode and which extends into the tank;

wherein the potentiostat is secured on the head of the holder and electrical connections between the potentiostat and the reference electrode as well as the external current anode are secured in this head.

4. The combination according to claim 3, wherein an electrical connection is secured on the head of the holder between the potentiostat and the tank wall.

5. The combination according to claim 3 where at least one additional terminal for at least one additional external currnt anode is provided on the potentiostat.

* * * * *

UNITED STATES PATENT OFFICE

CERTIFICATE OF CORRECTION

Patent No. 4,231,852 Dated Nov. 4, 1980

Inventor(s) Hans Rickert

It is certified that error appears in the above-identified patent and that said Letters Patent are hereby corrected as shown below:

In the heading of the Patent [75] should read as follows:

[75] Inventor: Hans Rickert, Dortmund, Fed. Rep. of Germany

Signed and Sealed this

*Third* Day of *November 1981*

[SEAL]

*Attest:*

GERALD J. MOSSINGHOFF

*Attesting Officer* *Commissioner of Patents and Trademarks*